US005419440A

United States Patent [19]

Picoult

[11] Patent Number: 5,419,440

[45] Date of Patent: May 30, 1995

[54] INTELLIGENT TRAYING FOR INSERTER SYSTEMS

[75] Inventor: Cheryl L. Picoult, Southbury, Conn.

[73] Assignee: Pitney Bowes Inc., Stamford, Conn.

[21] Appl. No.: 152,787

[22] Filed: Nov. 15, 1993

[51] Int. Cl.[6] ..... B07C 5/00

[52] U.S. Cl. ..... 209/583; 209/584; 209/900

[58] Field of Search ..... 209/3.1, 584, 583, 900; 271/298; 364/478

[56] References Cited

U.S. PATENT DOCUMENTS

| | | | |
|---|---|---|---|
| 4,547,846 | 10/1985 | Gottlieb | 209/900 X |
| 4,718,660 | 1/1988 | Daboub | 271/177 |
| 4,778,062 | 10/1988 | Pavie | 209/546 |
| 4,809,187 | 2/1989 | Adams | 209/900 X |
| 4,863,037 | 9/1989 | Stevens . | |
| 4,991,914 | 2/1991 | Kerstein . | |
| 5,104,681 | 4/1992 | Sansone | 209/584 X |
| 5,119,954 | 6/1992 | Svyatsky . | |
| 5,201,504 | 4/1993 | Fallos . | |
| 5,224,697 | 7/1993 | Darchis . | |
| 5,233,814 | 9/1993 | Bergerioux . | |
| 5,244,344 | 9/1993 | Doeberl et al. . | |
| 5,245,547 | 9/1993 | Ramsey . | |
| 5,292,008 | 3/1994 | Sansone et al. | 209/584 |

*Primary Examiner*—David H. Bollinger
*Attorney, Agent, or Firm*—Charles R. Malandra, Jr.; Melvin J. Scolnick

[57] ABSTRACT

In accordance with the present invention, a system for automated intelligent traying of mailpieces in accordance with predetermined postal discount requirements comprises an inserter for assembling the mailpieces and a trayer coupled to the inserter. The trayer includes a traying controller and a plurality of on-edge stacking bins. A supervisor is operatively coupled to the trayer controller for communicating mailpiece data and configuration data to and from the trayer controller. The trayer controller controls the sorting of mailpieces received from the inserter into tray groups according to postal discount requirements. In an alternate embodiment, the trayer is coupled to an on-edge mailpiece feeding structure such that the trayer is coupled to a system supervisor for performing automated intelligent traying separately from an inserter. In a further alternate embodiment, the trayer is off-line from an inserter or a supervisor and performs intelligent traying of mailpieces based solely on data scanned from the mailpiece and data downloaded to the trayer controller.

14 Claims, 10 Drawing Sheets

BLOCK REPRESENTATION

STACKING OF MAIL IN TRAYER BINS

BIN STATE CONTROL ALGORITHM

IN-BAND DATA SOURCES

OUT OF BAND DATA SOURCE

TRAYING ALGORITHM

INTELLIGENT TRAYING
WITH PRE-DETERMINED TRAY BREAKS

INTELLIGENT TRAYING WITH ON-LINE QUALIFICATION

SYSTEM DATA FLOW

INTELLIGENT TRAYING FOR INSERTER SYSTEMS

FIELD OF THE INVENTION

The invention disclosed herein relates generally to systems and apparatus for processing a large volume of mailpieces, and more particularly to systems and apparatus for processing mailpieces output from an inserter system.

RELATED APPLICATIONS

The present application is related to U.S. applications Ser. Nos. 08/152,791 and 08/152,790, filed concurrently herewith, and assigned to the assignee of the present invention.

BACKGROUND OF THE INVENTION

High volume mailers receive discounts in postal rates for meeting certain criteria established by the postal service. Generally, such criteria relates to a reduction in the postal service's handling of the mail from the mailers. For example, the United States Postal Service ("USPS") offers several levels of discounts to mailers. In order to maximize such postage discounts, the USPS requires that high volume mailers presort the mailpieces, apply a Zip+4 bar code to each mailpiece, and package their mail into trays with each tray tagged in accordance with the Domestic Mail Manual.

Heretofore, the sorting and traying processes required to qualify for the maximum discount could not be performed on an inserter system. Large volume mailers perform the sorting process on conventional off-line sorting equipment, however, the traying process is done manually. Smaller volume mailers may perform both the sorting and traying processes manually. In any event, the traying process must be done manually because the traying process has not been automated.

It is an object of the present invention to provide an automated traying system that provides the flexibility to realize discounts offered by the postal service.

It is a further object of the present invention to provide an automated traying system that interfaces with an inserter system.

SUMMARY OF THE INVENTION

The present invention provides an on line "intelligent traying" system that is a component of a larger production mail system comprising at least an inserter system and the traying system. The intelligent traying system is coupled to a production mail system supervisor and may or may not be physically coupled to the output of the inserter system. As used herein, "intelligent traying" means automatically forming finished trays of mail with tray tags and separator cards so that the tray qualifies for the maximum available postal discount.

In accordance with the present invention a traying system includes a trayer, a trayer controller and a plurality of on-edged stacker bins. The traying system performs the following functions: provides a mail stacking capability for high throughput inserters; applies zip +4 bar code on envelope (if needed); sorts mail into tray groups according to USPS or international postal regulations; inserts separator cards between US zip breaks or international zone breaks; prints tray tag labels (in both bar code and human readable format) identifying the contents and destination of the tray; outsorts exceptions according to job configuration rules; generates USPS or international Postal submittal documentation for the mail run; and performs document tracking to verify mailpiece and mail run integrity.

In accordance with the present invention, a system for automated intelligent traying of mailpieces in accordance with predetermined postal discount requirements comprises an inserter for assembling the mailpieces and a trayer coupled to the inserter. The trayer includes a traying controller and a plurality of on-edge stacking bins. A supervisor is operatively coupled to the trayer controller for communicating mailpiece data and configuration data to and from the trayer controller. The trayer controller controls the sorting of mailpieces received from the inserter into tray groups according to postal discount requirements.

In an alternate embodiment, the trayer is coupled to an on-edge mailpiece feeding structure such that the trayer is coupled to a system supervisor for performing automated intelligent traying separately from an inserter.

In a further alternate embodiment, the trayer is off-line from an inserter or a supervisor and performs intelligent traying of mailpieces based solely on data scanned from the mailpiece and data downloaded to the trayer controller.

DESCRIPTION OF THE DRAWINGS

The above and other objects and advantages of the present invention will be apparent upon consideration of the following detailed description, taken in conjunction with accompanying drawings, in which like reference characters refer to like parts throughout, and in which:

FIG. 5 is a data flow diagram for in-band configurations;

DETAILED DESCRIPTION OF THE PRESENT INVENTION

Figure 1:
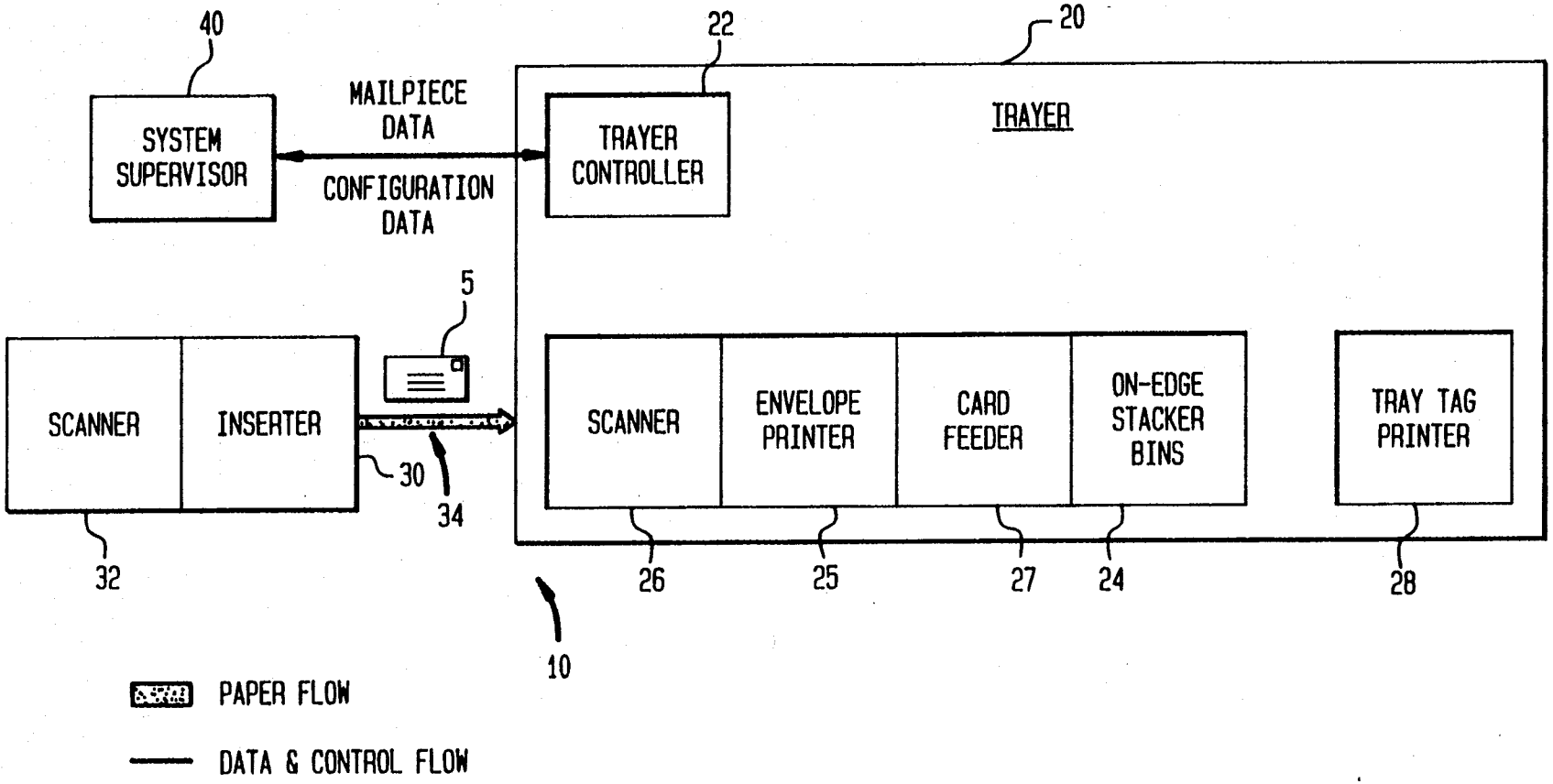
FIG. 1 is a block diagram of a trayer as part of a system in accordance with the present invention.

In describing the present invention, reference is made to the drawings, wherein there is seen in FIG. 1 a block diagram of an inserter and an intelligent trayer system 10. A trayer 20 physically interfaces to the output of an inserter 30. Mailpieces 5 are transported to trayer 20 after they are assembled, sealed and metered in inserter 30. Data and control signals are passed between a system supervisor 40 and a trayer controller 22. Trayer 20 performs basic stacking and sorting of mailpieces 5, and in accordance with the present invention, trayer 20 performs intelligent traying of the mailpieces.

In the preferred embodiment of the present invention, trayer 20 is physically coupled to inserter 30 such that mailpieces output by inserter 30 are transported directly to trayer 20. This is referred to herein as "on-line intelligent traying". A vertical transport interface 34 couples inserter 30 to trayer 20. For inserters that output mailpieces on a horizontal, interface 34 includes a device that turns the mailpieces to an vertical on-edge orientation. An example of an inserter is the 8300 series Inserters manufactured by Pitney Bowes Inc. of Stamford, Conn. An example of such a turn-up device and vertical transport is disclosed in U.S. patent applications Ser. Nos. 08/152,802 and 08/152,793, filed concurrently herewith and assigned to the assignee of the present invention, which is incorporated herein by reference.

In an alternate embodiment, trayer 20 is not physically couple to inserter 30 but performs the same functions described herein except that the mailpieces must be fed to trayer 20 by other than inserter 30. This is referred to herein as "off-line intelligent traying".

Figure 2:
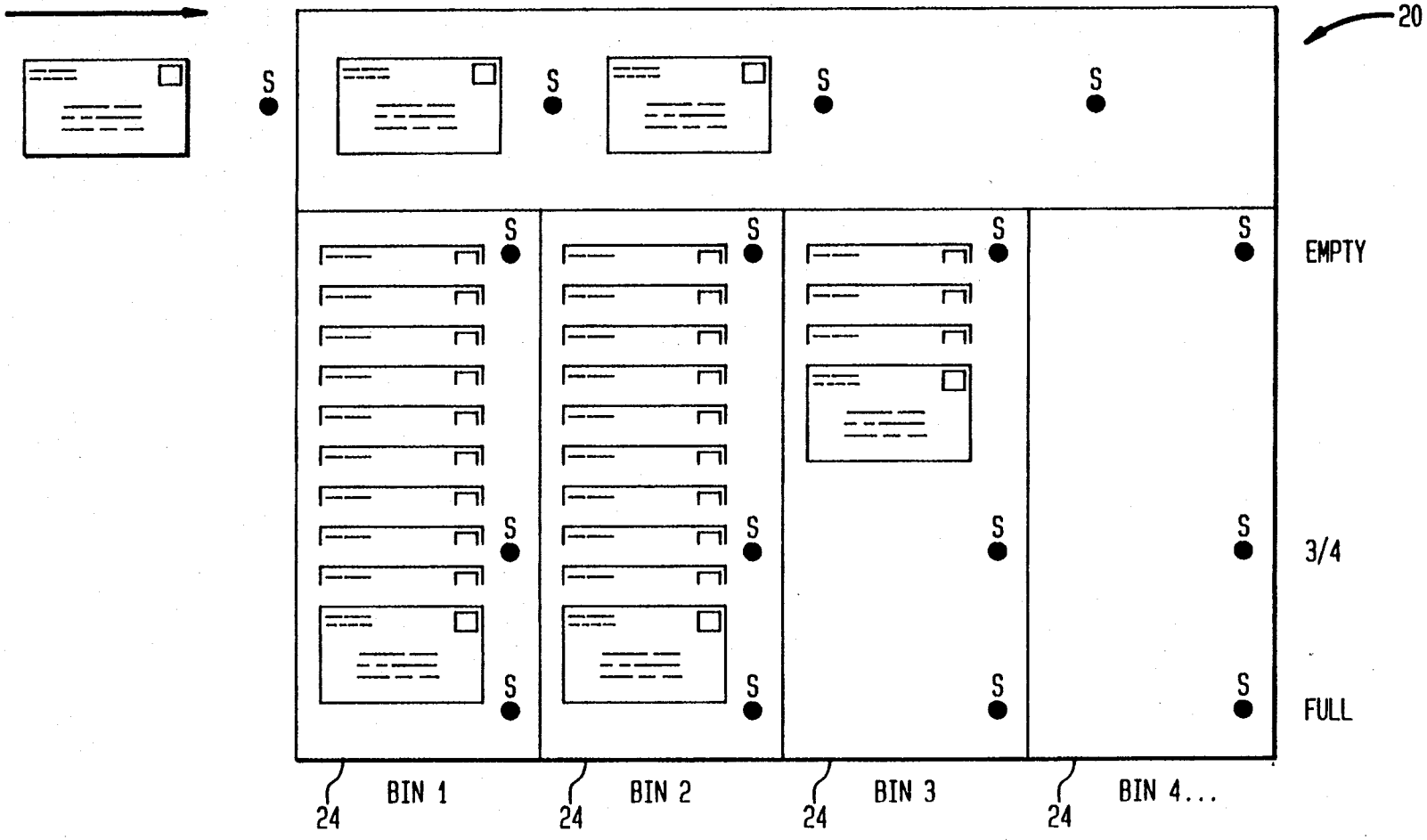
FIG. 2 is a block diagram of trayer bins for the trayer of FIG. 1.

Referring now to FIG. 2, trayer 10 provides a basic material stacking capability by supplying multiple stacking bins that meet the USPS discount requirements for tray length. In the preferred embodiment of the present invention, each trayer 20 consists of four stacking bins 24. Multiple trayers may be linked together to increase the number of stacking bins processing the mailpieces. Sensors S are located at strategic positions in trayer 20 and bins 24 to detect mailpieces and stack size. In bins 24, sensors S are located at the empty, ¾ and full positions.

Figure 3:
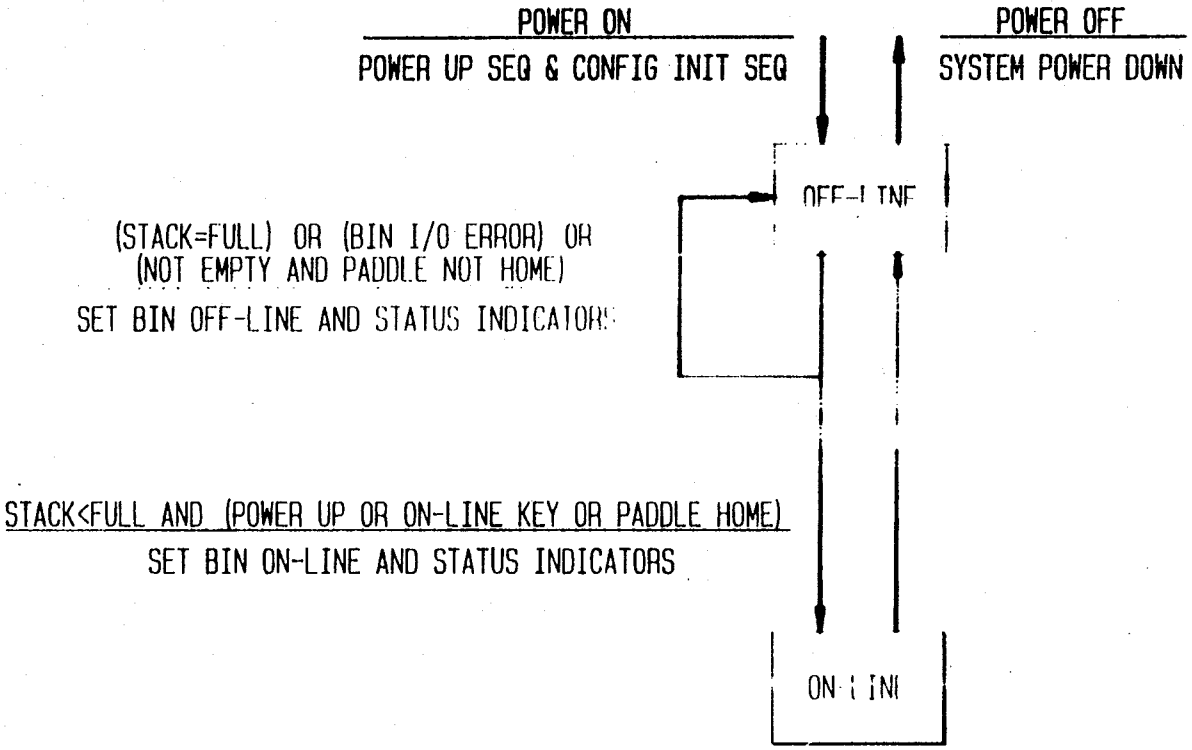
FIG. 3 is a flow diagram of a bin state algorithm for the trayer of FIG. 1.

Trayer controller 22 tracks each bin's state, i.e. on-line or off-line, stack size and configuration. FIG. 3 is a flow diagram of a bin state control algorithm showing the events which cause bins 24 to be on-line or off-line. At power-up the respective bins 24 are initialized to the on-line state if the bin paddle is in its normal position and the bin is not full. Typical events causing a bin 24 to be off-line are bin full, I/O error or paddle not in its normal position.

As previously noted, bins 24 may be configured for exception outsorting or for active stacking. In the basic stacking mode, on-line bins 24 are filled in successive order. As one bin 24 is filled, stacking automatically transfers to another one of bins 24. Trayer 20 also performs run time diagnostics to determine the health of all components and communication links.

Figure 4:
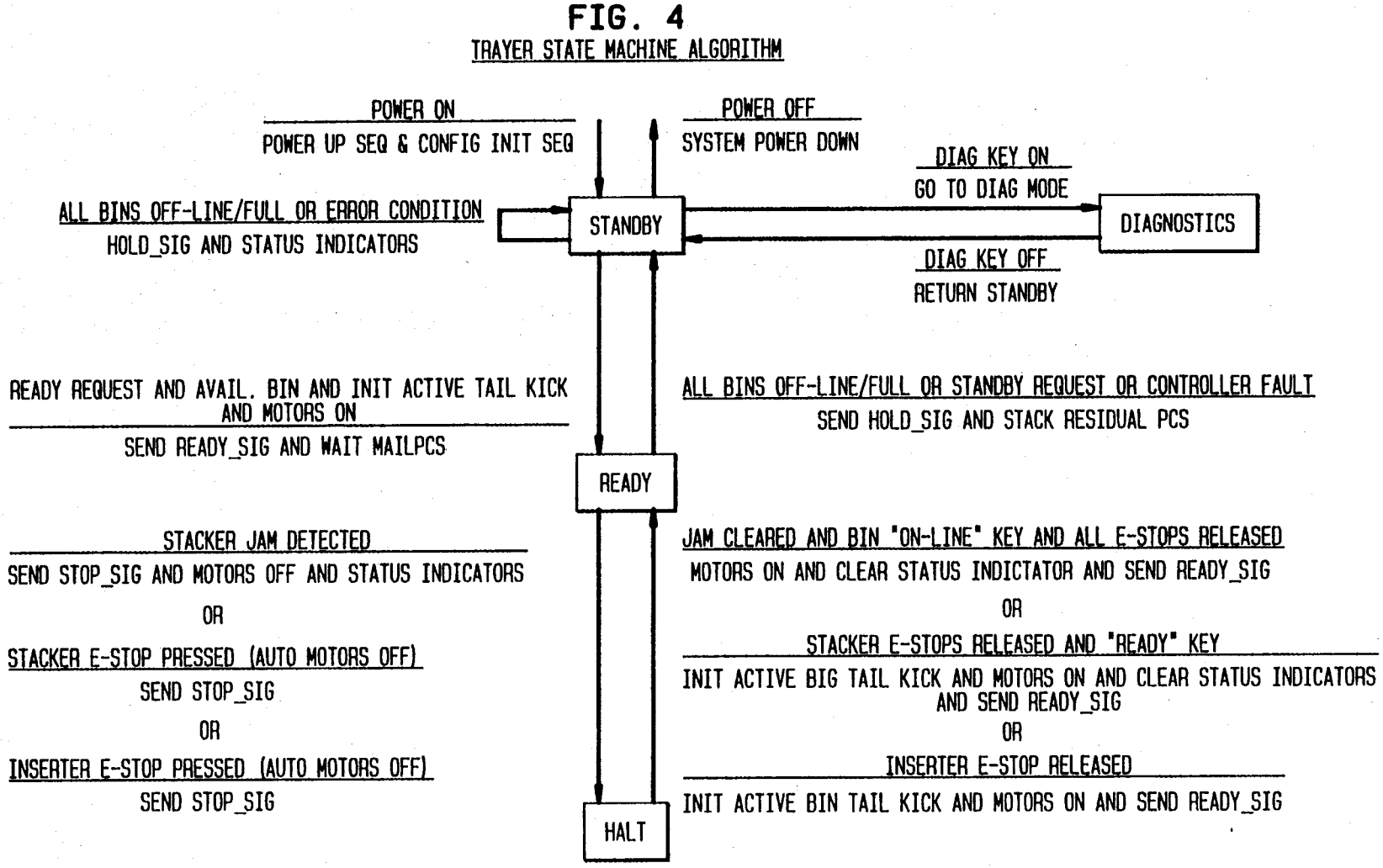
FIG. 4 is a flow diagram of a machine state algorithm for the trayer of FIG. 1.

Referring now to FIG. 4, the mailpiece flow between inserter 30 and trayer 20 is controlled by a state machine algorithm. State transitions of trayer 20 are event driven. Trayer 20 has four states: standby, ready, halt and diagnostics. At power-up trayer 20 is initialized to the standby state in which configuration and job set up data are downloaded from system supervisor 40 to trayer controller 22. Trayer 20 transitions to the ready state when the mail flow is started at inserter 30. Ready is the normal operating state in which mailpieces are received and trayed. If an exception condition, such as stacker jam, is detected, trayer 20 transitions to the halt state and the mail flow from inserter 30 is stopped. An off-line diagnostic state is used for fault isolation and correction.

In accordance with the present invention, trayer 20 performs intelligent traying in the following manner. The stack detection sensors S in bins 24 are used in connection with mailpiece data obtained "in-band", i.e., from inserter control codes printed on a control document, or "out-of-band", i.e., from information obtained from an electronic data file, referred to herein as a mail run data file ("MRDF"). Mailpieces can be scanned either by scanner 32 at the input of inserter 30, and/or at the entrance of trayer 20 by scanner 26. The MRDF is a file containing individual mailpiece records for all the mailpieces in the inserter run. This file is generated at the production mail system level.

Figure 5:
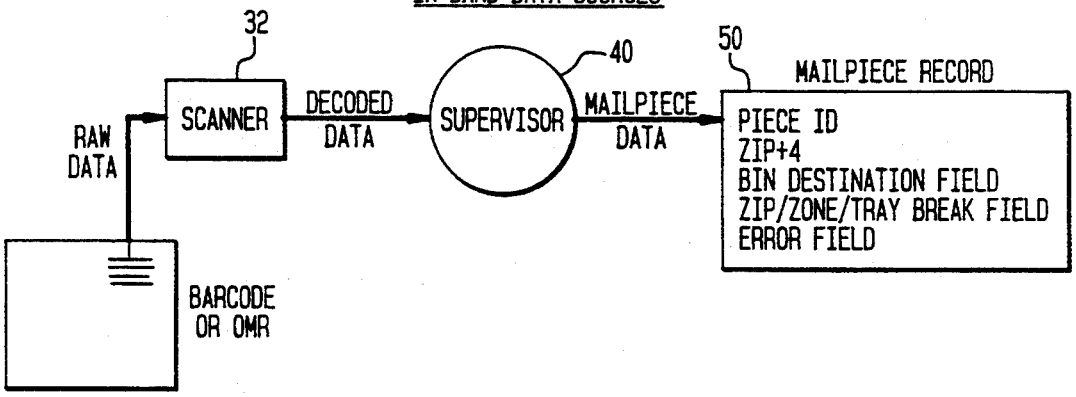
FIG. 5 is

Referring now to FIG. 5, the data flow for in-band configurations is shown. Mailpiece processing and traying data is printed on the control document either in bar code or OMR format. The raw scan data is interpreted and processed by system supervisor 40, which creates a mailpiece record 50. A pointer to this mailpiece record is passed to inserter modules in the system which tell the module how to process the specific mailpiece in inserter 30. Any errors detected during the mailpiece build in inserter 30 are appended to mailpiece record 50. Document tracking is performed internal within trayer 20 so that the mailpiece and mail run integrity may be verified against the MRDF. Mailpieces are outsorted to one of bins 24, that is designated for such outsorting, according to exception rules defined for the job application. Finally, each tray of mailpieces stacked in bins 24 is qualified and certified for USPS or international postal submittal.

Figure 6:
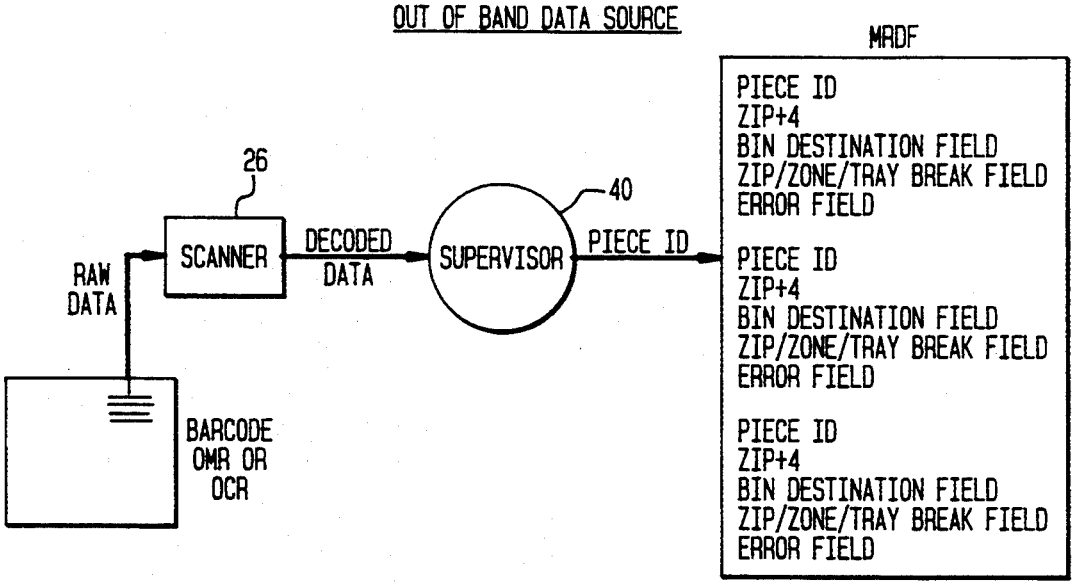
FIG. 6 is a data flow diagram for out-of-band configurations.

Referring now to FIG. 6, the data flow for out-of-band configurations is shown. An unique mailpiece ID is scanned from either the control document by inserter 30 or finished envelope by scanner 26 of trayer 20. The piece ID may be printed in bar code, OMR or OCR format. The piece ID may be a ZIP+4 code in OCR format. This unique piece ID is used as a pointer into the MRDF, which contains the individual mailpiece records for all pieces in the mail run. The mailpiece record has the same format as the one created by system supervisor 40 for the in-band configuration. For out-of-band configurations, however, a mail run integrity system ("MRIS") creates the mailpiece records and lists them in the MRDF. As in the in-band configuration, Trayer 20 performs document tracking, exception outsorting, integrity verification, and the USPS or international postal certification.

Figure 7:
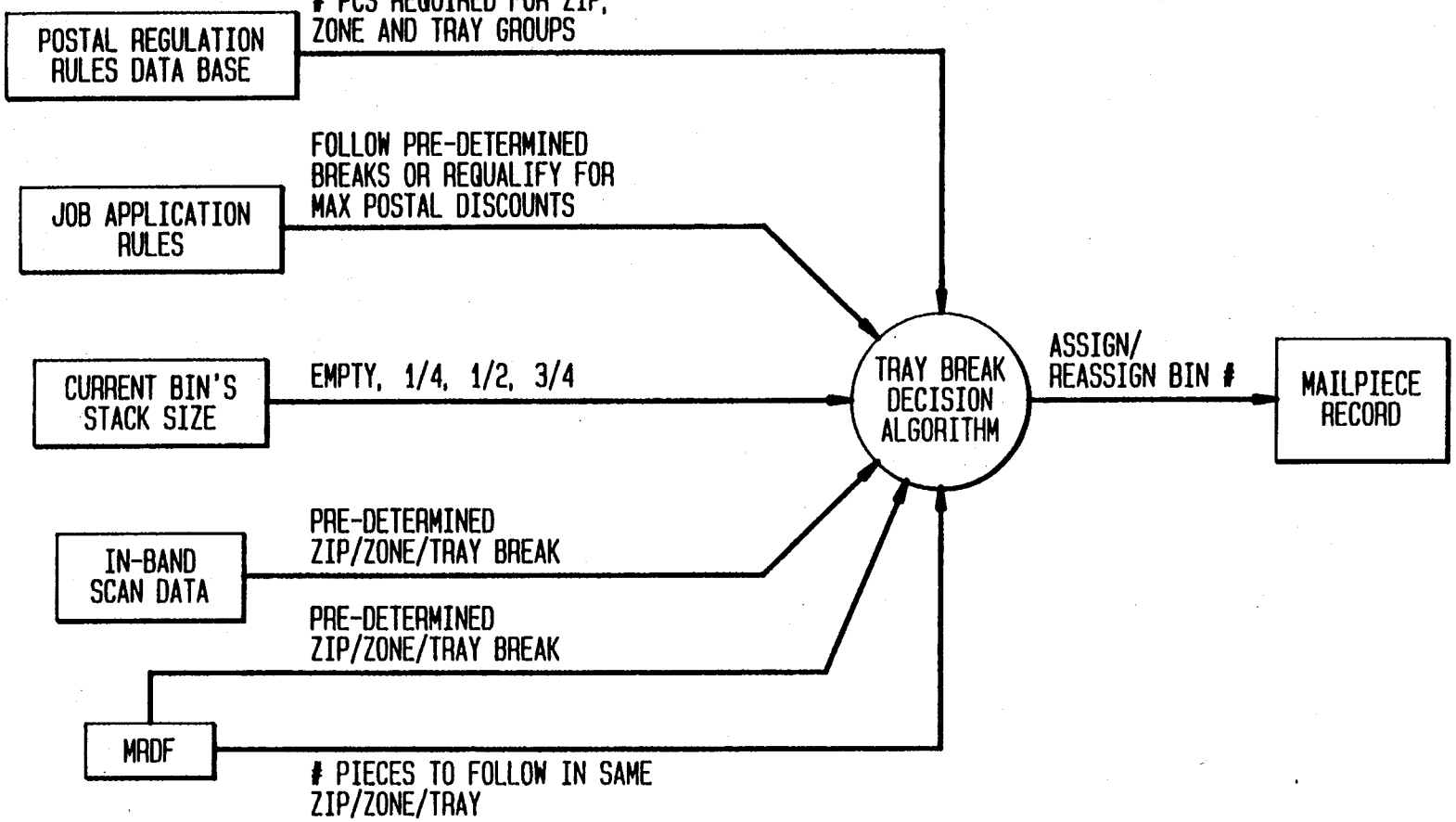
FIG. 7 is a data flow diagram of an intelligent traying algorithm.

Referring now to FIG. 7, the data flow of an intelligent traying algorithm is shown. Tray break decisions are based on the postal qualification regulations, such as the number of pieces required for Zip, zone and tray groups; job application rules, such as follow predetermined zip, zone, or tray breaks or requalify for maximum postal discounts; bin stack size; predetermined zip, zone and tray breaks; and from the MRDF, the number of mailpieces remaining within the same zip, zone or tray group. Required postal submittal documentation is generated based on the final tray content.

Figure 8:
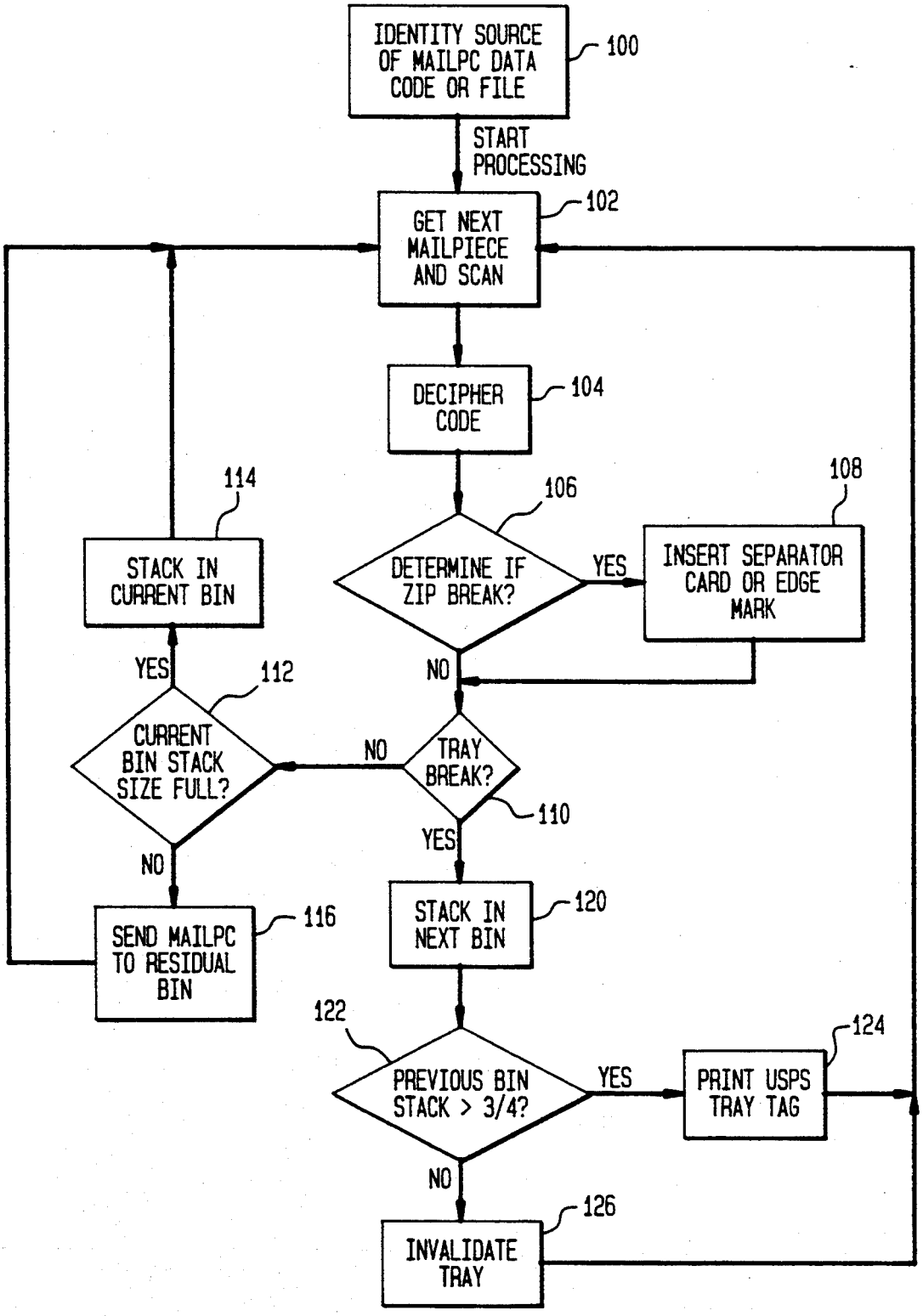
FIG. 8 is a flow chart for off-line intelligent traying.

Referring now to FIG. 8, the flow chart for intelligent traying with pre-determined qualification of postal discounts is provided. Initially at step 100, the source of the mailpiece data code or file is determined. At step 102, the processing begins by scanning the next mailpiece and deciphering the code on the mailpieces at 104. If the system determines a Zip break at 106, then, at 108, a separator card is inserted by card feeder 27 (FIG. 1). In either case, the system then checks for a tray break at 110. If a tray break is not detected then, at 110, and the current bin stack size if found to be less than full, at 112, the mailpiece is stacked in the current bin, at 114. If the current bin stack is full, the mailpiece is sent, at 116, to a residual bin and the processing returns to 102 for the next mailpiece. If a tray break was detected at 110, the mailpiece is stacked in the next bin, at 120. Once the stacking moves to the next bin, a check of the stack size of the previous bin is made, at 122. If the stack is more than ¾ full, a USPS tray tag is printed by tray tag printer 28 (FIG. 1) for the previous bin, at 124, and the processing returns to 102 for the next mailpiece. If the stack in the previous bin is less than ¾ full, it does not qualify for the traying discount and the tray is invalidated, at 126, and the processing returns to 102 for the next mailpiece.

Figure 9A:
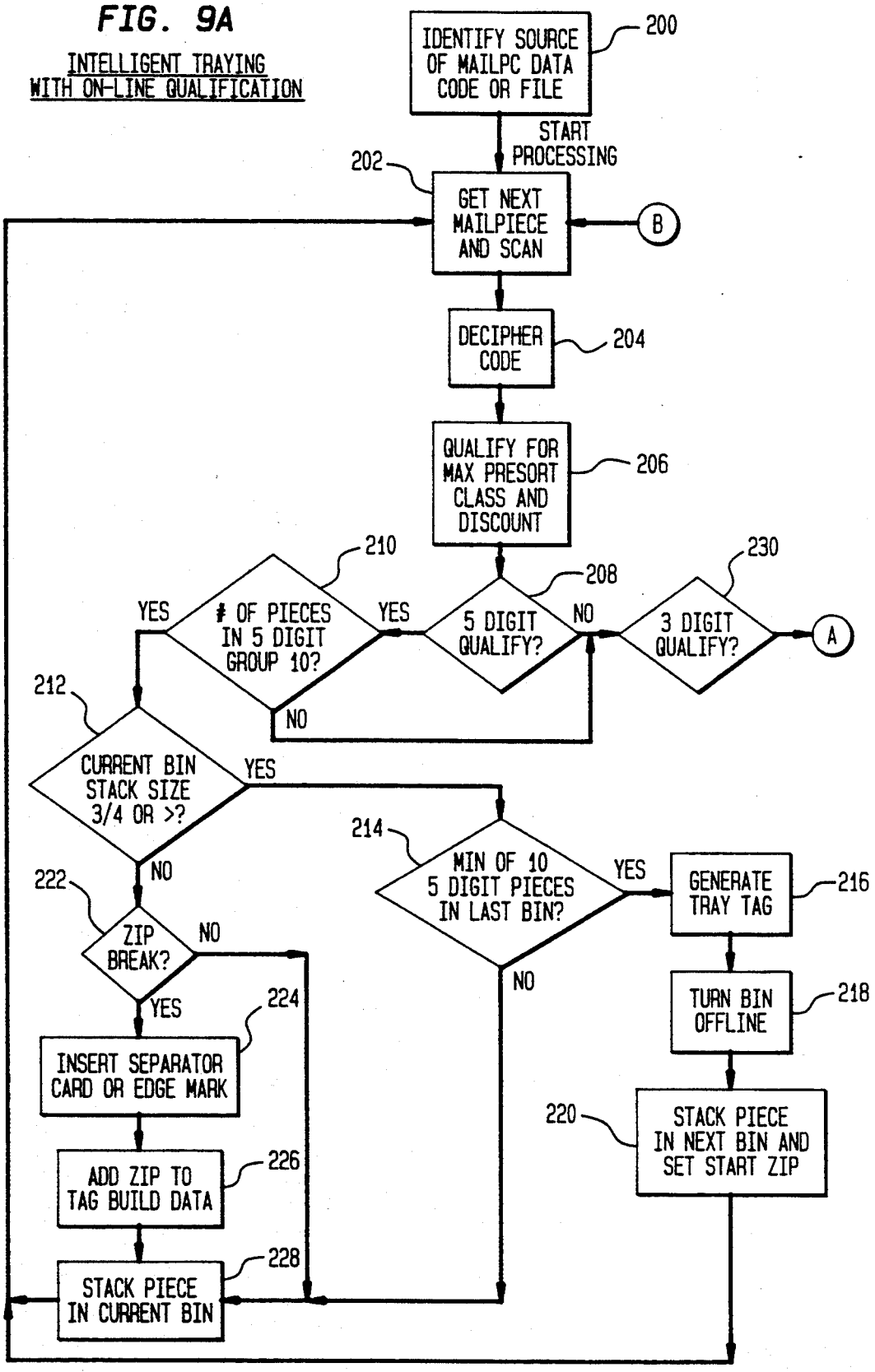
FIGS. 9*a* and 9*b* are a flow chart for on-line intelligent traying.
Figure 9B:
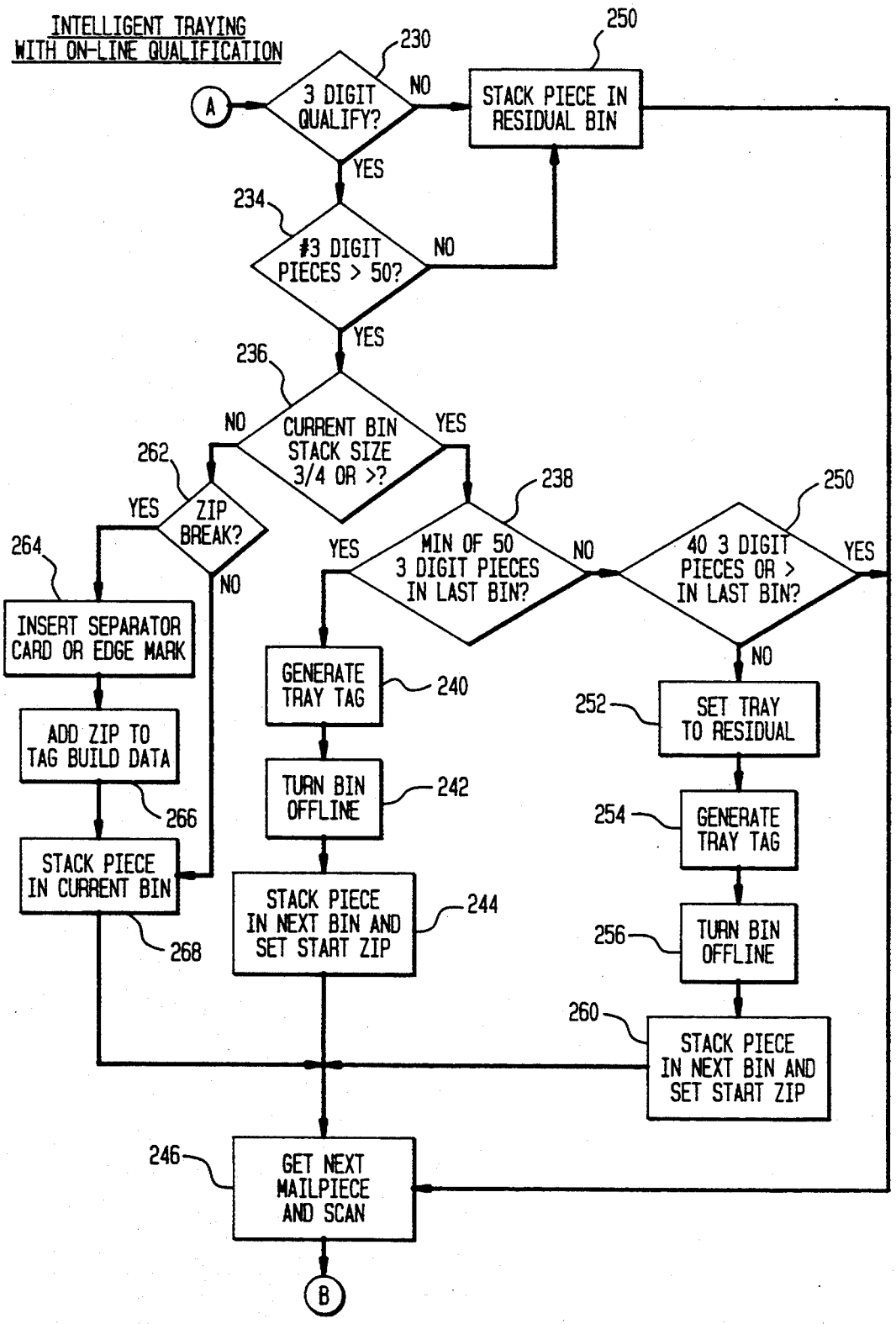

Referring now to FIG. 9, the flow chart for intelligent traying with on-line qualification for postal discounts is provided. Initially at step 200, the source of the mailpiece data code or file is determined. At step 202, the processing begins by scanning the next mailpiece and deciphering the code on the mailpieces, at 204. At 206, the system begins the on-line qualification for maximum presort discount.

At 208, a check is made to determine if the mailpiece qualifies for a 5 digit Zip discount. If it does not qualify then a check is made at 230 to determine if the mailpiece qualifies for a 3 digit Zip discount. However, if the mailpiece qualifies for the 5 digit discount, then at 210, the system determines if there is a minimum number of pieces required for the 5-digit discount. If there is less than the required number, then the processing moves to the 3 digit qualification for the mailpiece at 230. However, if there is at least the minimum number required for the 5-digit discount, then at 212, a check is made of the current bin stack size. If the bin is ¾ full or more then, at 214, a determination is made whether the bin contains the minimum required number of 5-digit pieces to qualify for the discount. If it does, at 216, a tray tag is printed and, at 218, the bin is turned off-line. At 220, the mailpiece is stack in the next bin and the next mailpiece is processed at 202.

If, at 214, it is determined that the bin contains less than the minimum number of 5-digit pieces, the mailpiece is stacked in the current bin, at 228, and the next mailpiece is processed at 202. If the current bin is less than ¾ full at 212, the system determines if there is a Zip break at 222. If there is a Zip break, a separator card is inserted at 224 by card feeder 27 (FIG. 1), the Zip is added to tagging data, at 226, and at 228, the mailpiece is stacked in the current bin. If there is no Zip break at 222, then the mailpiece is stacked in the current bin, at 228.

If the mailpiece does not qualify for a 3-digit discount either, then at 250 the mailpiece is stacked in a residual bin and the next mailpiece is processed. However, if the mailpiece qualifies for the 3-digit discount, then at 234, the system determines if there is a minimum number of pieces required for the 3-digit discount. If there is less than the required number, then the mailpiece is stacked in a residual bin at 250 and the next mailpiece is processed. However, if there is at least the minimum number required for the 3-digit discount, then at 236, a check is made of the current bin stack size. If the bin is ¾ full or more then, at 238, a determination is made whether the bin contains the minimum required number of 3-digit pieces to qualify for the discount. If it does, at 240, a tray tag is printed and, at 242, the bin is turned off-line. At 244, the mailpiece is stack in the next bin and the next mailpiece is processed at 202.

If there is less than the minimum number of pieces in the current bin to qualify for the 3-digit discount, at 250 a determination is made whether there are 40 or more pieces in the bin. If there are then the mailpiece is stacked in the current bin. If not, then at 252, the tray is set to residual, a tray tag is printed at 254 and, at 256, the bin is turned off-line. At 260, the mailpiece is stack in the next bin and the next mailpiece is processed at 202.

If the current bin is less than ¾ full at 236, the system determines if there is a Zip break at 262. If there is a Zip break, a separator card is inserted at 264 by card feeder 27 (FIG. 1), the Zip is added to tagging data, at 266, and at 268, the mailpiece is stacked in the current bin. If there is no Zip break at 222, then the mailpiece is stacked in the current bin, at 228. Once the mailpiece is stacked, processing moves to the next mailpiece.

Figure 10:
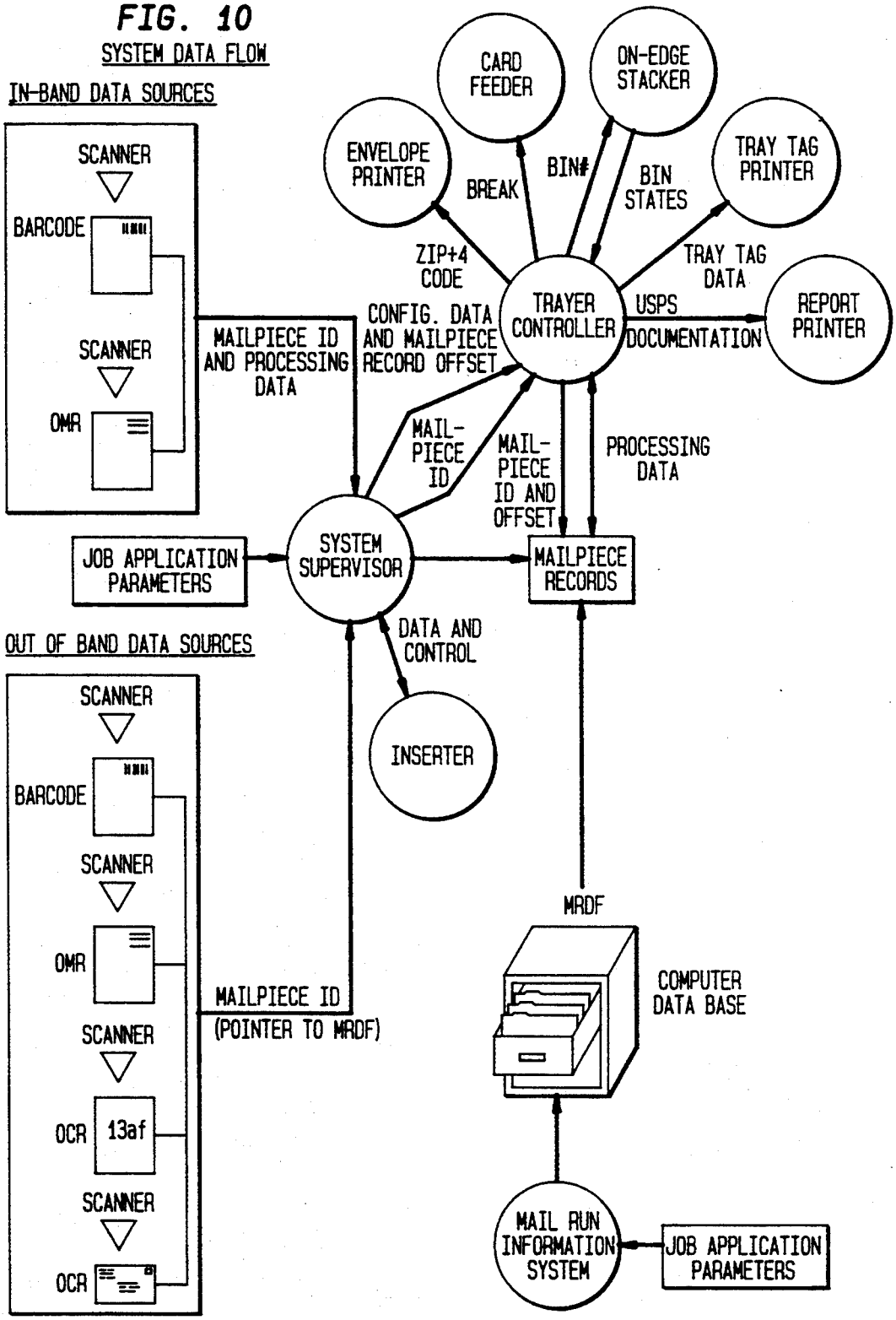
FIG. 10 is a system data flow diagram for the system of FIG. 1.

Referring now to FIG. 10, the system data flow relating to document tracking and use of the mailpiece record is shown. The mailpiece ID is passed along with the physical mailpiece between modules in trayer 20. The mailpiece ID is used as a pointer to the mailpiece record where processing data is stored. The mailpiece record is continually updated during the processing of the mailpiece. The number of fields required for the mailpiece record depends on the job application. The mailpiece record format is established by system supervisor 40 for in-band configurations, and by the MRIS for out-of-band configurations. Configuration data contains the offset for each module to use in order to access the necessary data fields within the mailpiece record. This allows each module to access only the fields it needs to perform its function. Modules can both read and write to the mailpiece record.

In accordance with the present invention, trayer 20 can be connected to an "unintelligent" inserter without a system supervisor. In such an arrangement, the trayer would operate with on-line qualification.

It is also noted that trayer 20 can be configured to do both intelligent traying and basic sorting. In such a configuration, certain bins would be designated for intelligent traying and the remaining bins would be designated for sorting.

While the present invention has been disclosed and described with reference to a single embodiment thereof, it will be apparent, as noted above that variations and modifications may be made therein. It is also noted that the present invention is independent of the machine being controlled, and is not limited to the control of inserting machines. It is, thus, intended in the following claims to cover each variation and modification that falls within the true spirit and scope of the present invention.

What is claimed is:

1. A system for automatically traying mailpieces in accordance with predetermined postal discount requirements, comprising:

an inserter for assembling the mailpieces;

a trayer coupled to said inserter, said trayer including a traying controller, a plurality of stacking bins and means for selectively conveying each of the mailpieces to one of said stacking bins;

a supervisor operatively coupled to said trayer controller for communicating mailpiece data and configuration data to and from said trayer controller;

wherein said trayer controller sorts the mailpieces by controlling the selective conveying means based on said mailpiece and configuration data to sort the mailpieces into tray groups according to postal discount requirements.

2. The system of claim 1 wherein said trayer further includes a card feeder for feeding separator cards identifying Zip breaks to one of said stacking bins when said trayer controller detects a Zip break based on said mailpiece data.

3. The system of claim 1 wherein said trayer further includes a tray tag printer for printing a tray tag when said tray controller determines that a stack of mailpieces in one of the stacking bins qualifies for a postal discount.

4. The system of claim 1 wherein said trayer further includes a scanner for scanning codes printed on the mailpieces, said trayer controller communicating data from said codes to said supervisor for generating a mailpiece record used by said trayer controller during the traying process.

5. The system of claim 1 wherein a scanner in said inserter scans codes printed on the mailpieces, said supervisor using data from said codes to generate a mailpiece record used by said trayer controller during the traying process.

6. The system of claim 1 wherein said trayer controller makes tray break decisions for each mailpiece being stacked based on a database containing postal discount requirements, job application rules, current bin's stack size, data scanned from the mailpiece and a mail run data file.

7. A system for automatically traying mailpieces in accordance with predetermined postal discount requirements, comprising:

means for feeding mailpieces on edge;

a trayer coupled to said feeding means, said trayer including a traying controller, a plurality of stacking bins and means for selectively conveying each of the mailpieces to one of said stacking bins;

a supervisor operatively coupled to said trayer controller for communicating mailpiece data and configuration data to and from said trayer controller; and a scanner for scanning codes printed on the mailpieces, said trayer controller communicating data from said codes to said supervisor for generating a mailpiece record used by said trayer controller during the traying process, wherein said trayer controller sorts the mailpieces by controlling the selective conveying means based on said mailpiece and configuration data to sort the mailpieces into tray groups according to postal discount requirements.

8. The system of claim 7 wherein said trayer further includes a card feeder for feeding separator cards identifying Zip breaks to one of said stacking bins when said trayer controller detects a Zip break based on said mailpiece data.

9. The system of claim 7 wherein said trayer further includes a tray tag printer for printing a tray tag when said tray controller determines that a stack of mailpieces in one of the stacking bins qualifies for a postal discount.

10. The system of claim 7 wherein said trayer controller makes tray break decisions for each mailpiece being stacked based on a database containing postal discount requirements, job application rules, current bin's stack size, data scanned from the mailpiece and a mail run data file.

11. A system for automatically traying mailpieces in accordance with predetermined postal discount requirements, comprising:

means for feeding mailpieces on edge;

a trayer coupled to said feeding means, said trayer including a traying controller, a plurality of stacking bins and means for selectively conveying each of the mailpieces to one of said stacking bins;

a mail run information system for communicating mailpiece records and a mail run data file to said trayer controller; and a scanner for scanning codes printed on the mailpieces, said trayer controller making traying decisions based on data from said scanned code, said mailpiece records and said mail run data file, wherein said trayer controller sorts the mailpieces by controlling the selective conveying means based on said mailpiece and configuration data to sort the mailpieces into tray groups according to postal discount requirements.

12. The system of claim 11 wherein said trayer further includes a card feeder for feeding separator cards identifying Zip breaks to one of said stacking bins when said trayer controller detects a Zip break based on said mailpiece data.

13. The system of claim 11 wherein said trayer further includes a tray tag printer for printing a tray tag when said tray controller determines that a stack of mailpieces in one of the stacking bins qualifies for a postal discount.

14. The system of claim 11 wherein said trayer controller makes tray break decisions for each mailpiece being stacked based on a database containing postal discount requirements, job application rules, current bin's stack size, data scanned from the mailpiece and a mail run data file.

* * * * *